US007682467B2

(12) United States Patent
Soshiroda et al.

(10) Patent No.: US 7,682,467 B2
(45) Date of Patent: Mar. 23, 2010

(54) HIGH STRENGTH HOT ROLLED STEEL SHEET SUPERIOR IN WORKABILITY, FATIGUE PROPERTY, AND SURFACE QUALITY

(75) Inventors: Tetsuo Soshiroda, Kakogawa (JP); Masaaki Miura, Kakogawa (JP); Tohru Shiogama, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 98 days.

(21) Appl. No.: 11/037,159

(22) Filed: Jan. 19, 2005

(65) Prior Publication Data

US 2005/0155673 A1 Jul. 21, 2005

(30) Foreign Application Priority Data

Jan. 21, 2004 (JP) ..... 2004-013227

(51) Int. Cl.
*C22C 38/00* (2006.01)

(52) U.S. Cl. ..... 148/333; 148/648

(58) Field of Classification Search ..... 148/333, 148/648

See application file for complete search history.

(56) References Cited

U.S. PATENT DOCUMENTS

| | | | | |
|---|---|---|---|---|
| 2002/0036035 | A1* | 3/2002 | Kashima et al. | 148/602 |
| 2009/0065098 | A1 | 3/2009 | Soshiroda et al. | |

FOREIGN PATENT DOCUMENTS

| | | | |
|---|---|---|---|
| JP | 58-210125 | | 12/1983 |
| JP | 08277439 | * | 10/1996 |
| JP | 9-31534 | | 2/1997 |
| JP | 09-031534 | * | 2/1997 |
| JP | 2003105444 | * | 4/2003 |
| JP | 2003-193186 | | 7/2003 |

* cited by examiner

*Primary Examiner*—Sikyin Ip
(74) *Attorney, Agent, or Firm*—Oblon, Spivak, McClelland, Maier & Neustadt, L.L.P.

(57) ABSTRACT

Disclosed is a high-strength hot-rolled steel sheet containing C in a range of 0.03 to 0.15 mass %, Mn in a range of 0.5 to 2 mass %, and Al in a range of 0.01 to 0.1 mass %, respectively, while controlling S to not more than 0.02 mass % (0% included), wherein the metallic structure thereof has a polygonal ferrite as the main phase, and contains martensite as a second phase, further containing P in a range of 0.030 to 0.08 mass %, and Cr in a range of 0.3 to 1.00 mass %, respectively, while controlling Si to not more than 0.1 mass % (0% included). Thus, a high-strength hot-rolled steel sheet superior in workability, and fatigue property, and excellent in surface quality is provided at a relatively low cost.

8 Claims, 1 Drawing Sheet

HIGH STRENGTH HOT ROLLED STEEL SHEET SUPERIOR IN WORKABILITY, FATIGUE PROPERTY, AND SURFACE QUALITY

BACKGROUND OF THE INVENTION

The invention relates to a high-strength hot-rolled steel sheet for use as a constituent material of an automobile wheel and suspension which are worked on by press forming, and in particular, to a high-strength hot-rolled steel sheet, superior in any of workability, fatigue property, and surface quality.

A demand for improvement in crash safety, and fuel economy of an automobile has recently become increasingly severer, and reduction in weight of an automobile body is highly desired as a countermeasure for meeting the demand. Since the weights of wheels and suspension parts, in particular, among automobile parts, occupy a high ratio in the weight of the automobile body in whole, the reduction in weight can be implemented if those parts are reduced in thickness by increasing the strength of a constituent material used in those parts.

Now, the wheels and suspension parts are worked on primarily by press forming, so that the constituent material thereof is desired to be superior in workability. Further, the constituent material need to be high in fatigue strength, and superior in durability so as to be able to minimize damage incurring while in use. In addition, even beauty of the external surface of some parts, as in the case of, for example, the wheels, is sometimes required.

Accordingly, there has been a demand for a high-strength hot-rolled steel sheet superior in any of properties such as workability, fatigue property, and surface quality, and as a method of producing the same, there has been proposed a technology disclosed in, for example, JP-A No. 9-31534. With the technology described, the surface quality as well as chemical processability of a steel sheet is improved by lowering Si content, and a ferrite phase is reinforced by adding Nb in combination with Ti to thereby enhance strength while improving workability. With the technology described, however, because Ti in combination with Nb are added as essential elements, a cost becomes high.

SUMMARY OF THE INVENTION

Under such circumstances, the invention has been developed, and it is an object of the invention to provide a high-strength hot-rolled steel sheet superior in workability, and fatigue property, and excellent in surface quality at a relatively low cost.

One preferred aspect of the present invention is directed to a high-strength hot-rolled steel sheet capable of solving the problems described, superior in workability, fatigue property, and surface quality has features in that the same contains:

C in a range of 0.03 to 0.15 mass %;

Mn in a range of 0.5 to 2 mass %;

Al in a range of 0.01 to 0.1 mass %;

P in a range of 0.030 to 0.08 mass %; and

Cr in a range of 0.3 to 1.00 mass %, respectively, while controlling S to not more than 0.02 mass % (0% included), and Si to not more than 0.1 mass % (0% included), wherein the metallic structure thereof has a polygonal ferrite as the main phase, and contains martensite as a second phase.

In the aspect, the polygonal ferrite is preferably not less than 75% in terms of volume fraction. The martensite is preferably in a range of 3 to 20% in terms of volume fraction.

In the aspect, the steel sheet preferably further contains, as other elements:

(a) Ni: 0.1 to 1 mass %, and/or Cu; 0.1 to 1 mass %;

(b) Co: 0.01 to 1 mass %;

(c) Ca: not more than 0.005 mass % (0% not included); and (d) at least one element selected from the group consisting of Nb: 0.01 to 0.3 mass %, Ti: 0.01 to 0.3 mass %, V: 0.01 to 0.5 mass %, Mo: 0.05 to 1 mass %, and B: 0.0003 to 0.01 mass %, and so forth.

With the invention, by adequately controlling respective contents of P, Cr, and Si, it is possible to provide the high-strength hot-rolled steel sheet superior in workability, and fatigue property, and excellent in surface quality at a relatively low cost even without addition of Nb in combination with Ti.

Other and further objects, features and advantages of the invention will appear more fully from the following description.

DETAILED DESCRIPTION OF THE PREFERRED EMBODIMENTS

In order to find a solution to the problems described, the inventor et al. have conducted studies from various angles, and as a result, have found out that for improving all of workability, fatigue property, and surface quality with respect to a hot rolled steel sheet, if the hot rolled steel sheet is turned into a dual-phase hot rolled steel sheet with a structure having polygonal ferrite as the main phase, and containing martensite in a predetermined amount as a second phase while controlling balance in content among elements P, Cr, and Si that are contained in the hot rolled steel sheet, the problems can be successfully solved, thereby completing the invention. There will be described in detail hereinafter the fundamental concept (fundamental philosophy) of a hot rolled steel sheet according to the invention while interweaving description with how the invention has come about.

In order to attain enhancement in workability of a hot rolled steel sheet, the inventor et al. have focused attention on a dual-phase hot rolled steel sheet with a structure having polygonal ferrite as the main phase, and containing martensite diffused therein as the second phase, and have since continued various studies on relationship between chemical composition of the dual-phase hot rolled steel sheet, and properties thereof, such as workability, fatigue property, and surface quality. As a result, it has been found out that if Si content is controlled as much as possible while P in combination with Cr are added, a dual-phase hot rolled steel sheet superior in any of workability, fatigue property, and surface quality can be obtained.

First, there are described hereinafter results of studies conducted on the effects of Si content and P content on the surface quality of a steel sheet.

Figure 1:
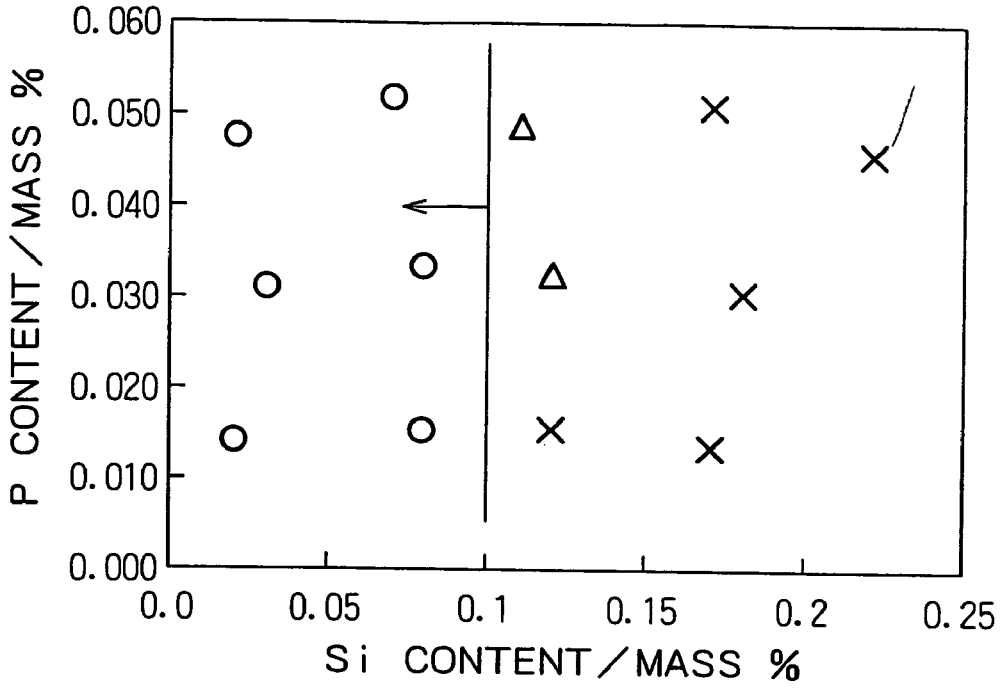
FIG. 1 is a graph showing results of evaluation made on the effect of Si content and P content, on surface quality of steel sheets.

FIG. 1 is a graph showing results of evaluation made on surface quality of steel sheets containing 0.10% of C, 1.5% of Mn, 0.005% of S, and 0.040% of Al, obtained by variously changing Si content and P content (as for a detailed evaluation procedure for surface quality, refer to an embodiment described hereunder). In FIG. 1, symbol ○ indicates a specimen with no scale mark observed, symbol Δ one with scale marks locally observed, and symbol X one with scale marks observed substantially throughout the surface thereof, respectively.

Further, the steel sheets were produced on the same conditions. More specifically, hot rolling was performed at rolling temperature: 880° C., primary cooling velocity (cooling velocity for a period from the rolling temperature up to primary cooling stop temperature): 50° C./sec, intermediate air cooling temperature (the primary cooling stop temperature): 680° C., intermediate air cooling time: 6 sec, secondary cooling velocity (cooling velocity for a period from intermediate air cooling completion temperature up to winding temperature): 35° C./sec, and the winding temperature: 100° C. The steel sheets obtained were of a dual-phase structure having polygonal ferrite as the main phase, and containing martensite in a range of 3 to 20% in volume fraction as a second phase.

As is evident from FIG. 1, the surface quality of the steel sheet was found excellent if Si content was controlled to not more than 0.1%. That is, if even a slight amount of Si is contained, scales are formed, creating a cause for generating surface defects, which in turn cause the surface quality to deteriorate. In the case of controlling Si content to around 0.13%, scaling characteristic undergoes a change by increasing P content as described later, so that the surface quality is improved to some extent, however, scale marks are still locally observed at times. If Si content is controlled to not more than 0.1%, however, excellent surface quality can be obtained with greater reliability.

Next, there are described hereinafter results of studies conducted on the effects of P content and Cr content on the workability, and fatigue property of a steel sheet.

Figure 2:
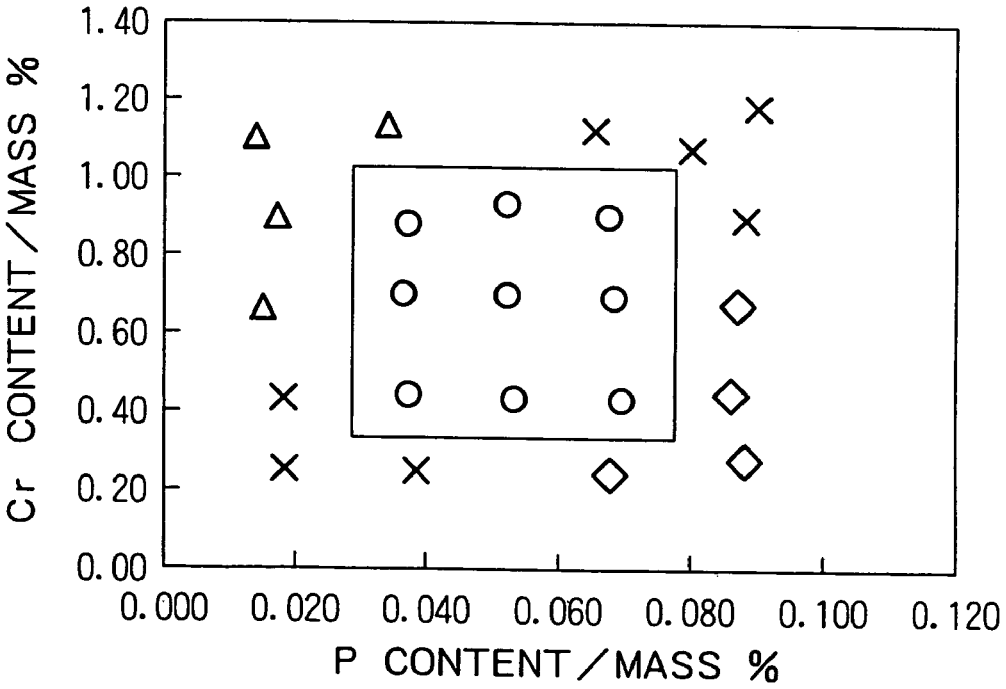
FIG. 2 is a graph showing results of evaluation made on the effect of P content and Cr content, on workability, and fatigue property of steel sheets, respectively.

FIG. 2 is a graph showing results of evaluation made on workability, and fatigue property of steel sheets containing 0.08% of C, 0.02% of Si, 1.5% of Mn, 0.005% of S, and 0.040% of Al, obtained by variously changing P content and Cr content (as for a detailed evaluation procedure for workability, and fatigue property, refer to the embodiment described hereunder). In FIG. 2, symbol ○ indicates a specimen excellent in both workability, and fatigue property, symbol ◇ one excellent in workability, but inferior in fatigue property, symbol Δ one excellent in fatigue property, but inferior in workability, and symbol X one inferior in both workability, and fatigue property, respectively.

Further, the steel sheets were produced on the same conditions. More specifically, hot rolling was performed at rolling temperature: 880° C., primary cooling velocity (cooling velocity for a period from the rolling temperature up to primary cooling stop temperature): 50° C./sec, intermediate air cooling temperature (the primary cooling stop temperature): 680° C., intermediate air cooling time: 6 sec, secondary cooling velocity (cooling velocity for a period from intermediate air cooling completion temperature up to winding temperature): 35° C./sec, and the winding temperature: 100° C. The steel sheets obtained were each 3.2 mm in thickness, and the metallic structure thereof was a dual-phase structure having polygonal ferrite as the main phase, and containing martensite in a range of 3 to 20 vol. % in terms of volume fraction as a second phase.

As is evident from FIG. 2, the both workability, and fatigue property of the steel sheet was found excellent if P content was controlled in a range of 0.030 to 0.08%, and Cr content was controlled in a range of 0.3 to 1.00%. More specifically, in the case of P content being not more than 0.030%, and in the case of Cr content being less than 0.3%, workability, and fatigue property deteriorate, however, if predetermined amounts of P and Cr, respectively, are contained, workability can be rendered compatible with fatigue property even if no Si is in effect contained. The reason for this is not fully understood, however, the inventor et al. take the view that affinity between P and Cr in steel exerts an influence upon the workability, and fatigue property. More specifically, as the affinity between P and Cr is excellent, compounds (for example, $CrPO_4$ etc.) are formed in steel. Meanwhile, it is deemed that these elements exist in the state of solid solution in steel before respective contents thereof exceed specified limits, and accordingly, if balance between P content and Cr content is adequately adjusted, problems, such as segregation, embrittlement, formation of carbide, excessive enhancement in hardenability, and so forth, occurring when excessive addition of P or Cr is singly made, will not easily occur, and in addition, the fatigue property is further improved due to the synergistic effect of addition of P and Cr.

Based on the above-described knowledge, with the hot rolled steel sheet according to the invention, it is important that P in a range of 0.030 to 0.08%, and Cr in a range of 0.3 to 1.00% are positively contained, respectively, and Si content is controlled to not more than 0.1% (0% included).

Now, there is described hereinafter a structure featuring the hot rolled steel sheet according to the invention.

The hot rolled steel sheet according to the invention preferably has a metallic structure having polygonal ferrite as the main phase, and containing martensite as a second phase, and the martensite is preferably in a range of 3 to 20% in terms of volume fraction.

The steel sheet with the polygonal ferrite as the main phase is excellent in ductility and the workability of the steel sheet can be enhanced. Herein the polygonal ferrite is ferrite low in dislocation density, and includes quasi-polygonal ferrite, excluding, however, ferrite high in dislocation density, such as acicular ferrite, bainitic ferrite, and so forth. The reason for this is because the ferrite high in dislocation density causes deterioration in ductility of the steel sheet.

The main phase refers to a phase acting as the main body of the structure of a steel sheet, and more specifically, refers to a phase in excess of 50% in terms of volume fraction. A ratio of the polygonal ferrite to the whole structure is preferably not less than 75% in volume fraction, more preferably, not less than 80%. However, if the polygonal ferrite exceeds 97% in volume fraction, an amount of martensite produced becomes too small, so that the polygonal ferrite needs to be not more than 97% in volume fraction, and is preferably not more than 93% in volume fraction.

The structure of the hot rolled steel sheet according to the invention needs to contain martensite as the second phase, and a ratio of the martensite to the whole structure is preferably in a range of 3 to 20% in volume fraction. With the hot rolled steel sheet having the polygonal ferrite as the main phase, and the martensite as the second phase, it is possible to lower a yield ratio (a ratio of yield strength to tensile strength), and to increase homogeneous elongation and breaking elongation, thereby improving balance between strength and ductility. However, with the martensite at less than 3% in volume fraction, it becomes impossible to secure three properties of a low yield ratio, high ductility, and high fatigue strength, so that the martensite is preferably at not less than 3% in volume fraction. On the other hand, if a ratio of the martensite exceeds 20% in volume fraction, ductility deteriorates although the strength of the steel sheet increases, thereby causing the steel sheet unable to cope with severe working conditions, so that the martensite is preferably at not more than 20% in volume fraction.

As described in the forgoing, the hot rolled steel sheet according to the invention is made of the dual-phase steel with the structure having the polygonal ferrite as the main phase, and containing the martensite as the second phase, however, the dual-phase steel may contain pearlite, bainite, retained austenite, and so forth, as a third phase, provided that it is in a small amount. However, if a ratio of the third phase to the whole structure becomes high, a relative ratio of the second phase (the martensite) decreases, so that desired effects cannot be obtained. Accordingly, the third phase is preferably controlled to not more than 5%, more preferably, to not more than 3% in volume fraction.

The volume fractions of respective constituents, occupying in the structure of steel, can be calculated by making image analysis of pictures taken by use of an electron microscope. More specifically, assuming that the thickness of a steel sheet was t, regions each 0.01 $mm^2$ at arbitrary three spots were selected from a cross-section of the steel sheet, in the direction of rolling, at a depth t/4 from the surface of the steel sheet, and pictures of the respective regions were taken at 1000× magnification by a scanning electron microscope, thereby calculating area percentages of the respective constituents by conducting image analysis of the pictures taken. The area percentages are taken as volume fractions in the metallic construction.

Next, basic components of the hot rolled steel sheet according to the invention are described. Chemical components given hereunder are all in units of mass %.

The steel sheet according to the invention contains C in a range of 0.03 to 0.15%, Mn in a range of 0.5 to 2%, and Al in a range of 0.01 to 0.1% as the basic components while controlling S to not more than 0.02% (0% included). The reason for determining those ranges as above is described hereinafter.

C: 0.03 to 0.15%

C is an important element for increasing the strength of the steel sheet, and in particular, for forming martensite. In order to cause C to effectively exhibit such functions, it is necessary to contain not less than 0.03% of C. However, if C content becomes excessive, formation of polygonal ferrite which is to become the main phase will become difficulty, thereby causing deterioration in ductility, and resulting in poor weldability. Accordingly, C content needs to be controlled to not more than 0.15%.

Mn: 0.5 to 2%

Mn is an important element for enhancing hardenability, and obtaining a dual-phase steel as desired, acting also as a solid solution hardening element. In order to cause Mn to effectively exhibit such functions, at least 0.5% of Mn needs to be contained. However, if Mn content is excessive, it will become difficult to form the polygonal ferrite, thereby causing not only deterioration in ductility, but also deterioration in workability and weldability, due to segregation of Mn, so that the upper limit of Mn content is set to 2%.

Al: 0.01 to 0.1%

Al is a deoxidizer element, and not less than 0.01% of Al needs to be contained. That is, with the hot rolled steel sheet according to the invention, in order to reduce Si content as much as possible, it is necessary to positively add Al to replace Si as a deoxidizer element. However, even if Al is excessively added, the effect thereof will reach saturation, and Al will rather act as a source for formation of oxide-based inclusions, thereby causing deterioration in ductility. Accordingly, the upper limit of Al content is set to 0.1%.

S: not more than 0.02% (0% included)

S forms sulfide-based inclusions in steel, thereby causing deterioration in formability (particularly ring forging property), and resulting in poor spot weldability, so that S is preferably reduced as much as possible, however, since S is mixed in as an unavoidable impurity, S content up to 0.02% is permissible. In order to ensure localized ductility, in particular, of a steel sheet, S content is preferably controlled to not more than 0.005%.

It is important that the hot rolled steel sheet according to the invention contains P in a range of 0.030 to 0.08%, and Cr in a range of 0.3 to 1.00%, respectively, in addition to the basic components described as above, while controlling Si to not more than 0.1% (0% included).

P: 0.030 to 0.08%

P is an element for effecting solid solution hardening of the polygonal ferrite, and addition of P in a small amount results in excellent balance between strength and ductility. However, addition of P in excess of 0.030% in the past caused deterioration in balance between strength and ductility instead, furthermore resulting in deterioration in toughness and weldability. Accordingly, positive addition of P has never been practiced. Notwithstanding the past practice, with the hot rolled steel sheet according to the invention, by combined addition of P and Cr as described in the foregoing, it is possible to improve workability and fatigue property because of the effect of combined use of P and Cr without causing an ill effect due to excessive addition of P. It is necessary to add P in excess of 0.030% to cause such an advantageous effect to be effectively exhibited. However, if P is excessively added, this will cause P to be bonded to Cr to produce fragile compounds, thereby creating a cause for formation of clusters, so that the advantageous effect due to the combined addition of P and Cr is impaired instead. Hence the upper limit of P content needs to be 0.08%. P content is more preferably not more than 0.080%.

Cr: 0.3 to 1.00%

Cr is an element for enhancing hardenability, and is also an element for stabilizing austenite during a cooling period after hot rolling, and facilitating formation of martensite. Accordingly, if Cr content is increased, more martensite is formed, but on the other hand, an amount of the polygonal ferrite formed is decreased, resulting in deterioration in ductility. Nevertheless, with the hot rolled steel sheet according to the invention, even if Cr is added such that its content is on a slightly high side, this will not cause deterioration in workability, and furthermore, can enhance fatigue property by the effect of the combined addition of P and Cr as previously described. It is necessary to have not less than 0.3% of Cr contained to cause such an effect to be effectively exhibited, and Cr content is preferably not less than 0.30%. However, excessive addition of Cr will cause the advantageous effect due to the addition of Cr in combination with P to reach saturation, resulting in no further improvement of fatigue property, and rather creating a cause for forming fragile compounds produced by bonding of Cr to P, and clusters, so that there occurs deterioration in ductility and conversion treatment property. Accordingly, the upper limit of the Cr content needs to be 1.00%.

Si: Not More Than 0.1% (0% Included)

Si acts as a deoxidizer element, and besides, has a function of promoting transformation from γ-iron (austenite) to α-iron (ferrite) after hot rolling, and facilitating the formation of martensite by releasing carbon dissolved in α-iron in solid solution state into γ-iron. However, even if a small amount of Si is contained, it will form oxides, thereby causing deterioration in surface quality, and creating a cause for surface defects. The surface defects will create a cause for deterioration in fatigue property. Accordingly, with the invention, Si content needs to be controlled to not more than 0.1%, and is preferably not more than 0.05%.

The hot rolled steel sheet according to the invention contains C in a range of 0.03 to 0.15%, Mn in a range of 0.5 to 2%, Al in a range of 0.01 to 0.1%, P in a range of 0.030 to 0.08%, and Cr in a range of 0.3 to 0.08%, as essential components, respectively, while controlling S to not more than 0.02% (0% included), and Si to not more than 0.1%, respectively, with the balance comprising Fe, and unavoidable impurities (for example, Mg, Zr, As, Se, and so forth), and may further contain, as other elements:

(e) Ni: 0.1 to 1%, and/or Cu; 0.1 to 1%;

(f) Co: 0.01 to 1%;

(c) Ca: not more than 0.005% (0% not included); and (d) at least one element selected from the group consisting of Nb: 0.01 to 0.3%, Ti: 0.01 to 0.3%, V: 0.01 to 0.5%, Mo: 0.05 to 1%, and B: 0.0003 to 0.01%, and so forth. Those ranges are set for the following reasons:

(a) Ni: 0.1 to 1%, and/or Cu; 0.1 to 1%

Ni is an element capable of enhancing hardenability and toughness without impairing weldability. In order to cause such effects to be effectively exhibited, at least 0.1% of Ni is preferably added, and not less than 0.3% of Ni is more preferably added. However, since excessive addition of Ni will increase cost, the upper limit of Ni content is preferably 1%, and is more preferably not more than 0.5%.

In contrast, Cu is an element effective for solid solution hardening and precipitation hardening, and is an element effective for strengthening a steel sheet without impairing elongation flanging property. Further, fatigue property as well is enhanced by addition of common Cu. In order to cause such effects to be effectively exhibited, at least 0.1% of Cu is preferably added, and not less than 0.3% of Cu is more preferably added. However, even if Cu is excessively added, the effect of such addition will be simply saturated, resulting in an increase of cost. Accordingly, the upper limit of Cu content is preferably 1%.

Those elements each may be added singly, however, when adding Cu, addition thereof, in combination with Ni, is preferable to avoid hot brittleness. In the case of the combined addition of Cu and Ni, an addition amount of Ni is preferably in a range from an amount equivalent to that of Cu to about ⅓ of that of Cu.

(b) Co: 0.01 to 1%

Co is an element for generally causing deterioration in hardenability, and is rarely added to a dual-phase steel (transformation structure steel). However, with the hot rolled steel sheet according to the invention, since P in combination with Cr are added, Co exhibits an effect of improving ductility due to the cleaning action of the polygonal ferrite. In order to cause such an effect to be effectively exhibited, not less than 0.01% of Co is preferably added. However, even if Co is excessively added, the effect of such addition will be simply saturated, resulting in an increase of cost. Accordingly, the upper limit of Co content is set to 1%, and is more preferably not more than 0.5%.

(e) Ca: Not More Than 0.005% (0% Not Included)

Ca is an element for controlling morphology of sulfide-based inclusions, enhancing ductility (particularly, elongation flanging property) of a steel sheet by spheroidizing of the morphology of the sulfide-based inclusions. Such an effect can be effectively exhibited by addition of even a small amount of Ca, however, if Ca is excessively added, not only the effect of such addition is saturated, but also cleanliness of the steel sheet deteriorates, so that Ca content is preferably controlled to not more than 0.005%.

Further, as the morphology of the sulfide-based inclusions can be controlled by addition of REM in place of Ca, REM may be added where necessary. In such a case, REM content is preferably set to not more than 0.01%, and is more preferably set to not more than 0.005%.

(d) At Least One Element Selected From the Group Consisting of Nb: 0.01 to 0.3%, Ti: 0.01 to 0.3%, V: 0.01 to 0.5%, Mo: 0.05 to 1%, and B: 0.0003 to 0.01%

Any of elements Nb, Ti, V, Mo, and B is an element contributing to enhancement in hardenability, and particularly, V and Mo contribute to not only enhancement in hardenability, but also to increase in strength by the agency of precipitation hardening. In order to cause such effects to be effectively exhibited, it is preferable to add not less than 0.01% of V, and not less than 0.05% of Mo. However, since V and Mo are more prone to be bonded to P than Cr is, if those elements are excessively added, this will rather interfere with the effect of the combined addition of P and Cr, eventually creating a cause for considerable deterioration in ductility, due to excessive precipitation hardening. Accordingly, it is preferable to set the upper limit of V content to 0.5%, and the upper limit of Mo content to 0.1%. More preferably, the upper limit of V content is set to not more than 0.2%, and that of Mo content is set to not more than 0.5%.

Meanwhile, B is an element effectively acting for enhancing hardenability, and obtaining a dual-phase steel. In order to cause such an effect to be effectively exhibited, not less than 0.0003% of B is preferably added. However, if B is excessively added, not only the effect of such addition is saturated, but also the ductility of the dual-phase steel deteriorates, so that the upper limit of B content is preferably set to not more than 0.01%, more preferably to not more than 0.002%.

On the other hand, Nb and Ti are expensive elements, and from the viewpoint of cost, addition thereof should be avoided. With the hot rolled steel sheet according to the invention, in particular, since the elements P, Cr, and Si, in proper balance, are added, desired effects can be obtained even without addition of Nb and Ti. In case that a cost aspect is disregarded, however, it will pose no problem at all to have Nb and Ti contained as further addition elements.

Nb and Ti act as elements for effecting precipitation hardening, or enhancing hardenability, contributing to increase in strength. In order to cause such an effect to be effectively exhibited, it is preferable to add not less than 0.01% of Nb and not less than 0.01% of Ti. More preferably, not less than 0.02% of Nb, and not less than 0.05% of Ti are added. However, since Nb and Ti are more prone to be bonded to P than Cr is as with the cases of the elements previously described, such as V, Mo, and B, if these elements are excessively added, this will rather interfere with the effect of the combined addition of P and Cr, eventually creating a cause for considerable deterioration in ductility, due to excessive precipitation hardening. Accordingly, it is preferable to set the upper limit of Nb content to 0.3%, and the upper limit of Ti content to 0.3%. More preferably, the upper limit of Nb is not more than 0.1%, and the upper limit of Ti is not more than 0.2%.

An aggregate content of Nb, Ti, V, Mo, and B is preferably adjusted so as to be in a range that does not exceed Cr content in terms of atomic equivalent ratio as shown by the following formula:

$$(Nb/92.9+Ti/47.9+V/50.9+Mo/95.9+B/10.8)<Cr/52$$

It need only be sufficient that the hot rolled steel sheet according to the invention satisfy the above requirements, and a method of producing the same will be described hereinafter by way of example although there is no particular limitation to the method of producing the same.

In order to produce a steel sheet structure having polygonal ferrite as the main phase, causing martensite to be formed as the second phase, and to adjust a ratio of the martensite to the whole structure in a range of 3 to 20% in volume fraction, cooling, particularly, after hot rolling is preferably executed in two stages with intermediate air cooling interposed therebetween. That is, it is desirable to adequately control rolling temperature for hot rolling, cooling velocity for a period from the rolling temperature up to intermediate air cooling temperature (hereinafter also referred to as primary cooling velocity), intermediate air cooling temperature (that is, primary cooling stop temperature), intermediate air cooling temperature (that is, primary cooling stop temperature), intermediate air cooling time, cooling velocity for a period from intermediate air cooling completion temperature up to winding temperature (hereinafter also referred to as secondary cooling velocity), the winding temperature, and so forth. More specifically, the method is described hereinafter.

With no particular restriction on hot rolling conditions, hot rolling may be executed at a temperature in a range of about 800 to 1100° C. as in the conventional case, but the rolling temperature is in a range of about 800 to 950° C. If the rolling temperature is lower than 800° C., a dual-phase region is formed during rolling operation, thereby causing the structure to become heterogeneous while if the rolling temperature exceeds 950° C., austenite grains become coarse, thereby retarding precipitation of ferrite, and rendering it difficult to secure a sufficient amount of ferrite.

Cooling after the hot rolling is preferably executed in two stages with the intermediate air cooling interposed therebetween. With the intermediate air cooling interposed between the two stages, a metallic structure can have two phases consisting of ferrite and martensite. At this point in time, the primary cooling stop temperature (that is, the intermediate air cooling temperature) is preferably in a range of about 650 to 700° C., and the intermediate air cooling time is preferably set to on the order of 3 to 20 sec. If the intermediate air cooling temperature is below about 650° C., ferrite transformation will not sufficiently proceed, and on the other hand, if the intermediate air cooling temperature exceeds about 700° C., concentration of carbon in austenite will not sufficiently proceed. Further, with the intermediate air cooling time less than about 3 sec, the ferrite transformation does not sufficiently proceed, and in contrast, with the intermediate air cooling time in excess of about 20 sec, it becomes difficult to retard pearlite transformation.

The cooling velocity for the period from the rolling temperature up to the intermediate air cooling temperature (the primary cooling velocity) is preferably in a range of about 20 to 100° C./sec. If the primary cooling velocity is less than 20° C./sec, coarse ferrite is generated, and if the primary cooling velocity exceeds 100° C./sec, uniform cooling will become difficult to attain, resulting in a heterogeneous structure.

The cooling velocity for the period from the intermediate air cooling completion temperature up to the winding temperature (the secondary cooling velocity) is preferably not less than 20° C./sec. With the secondary cooling velocity less than 20° C./sec, it is impossible to control pearlite transformation, and bainite transformation.

The winding temperature is preferably between about 350° C. and room temperature. If the winding temperature exceeds 350° C., the second phase cannot be turned into martensite.

The hot rolled steel sheet according to the invention is superior in any of properties such as workability, fatigue property, and surface quality in spite of high strength thereof, so that the same is suitable in application as a constituent material of automobile parts such as, for example, automobile wheels, suspension components, and so forth.

WORKING EXAMPLES

The invention is described in more detail hereinafter with reference to working examples. It is to be pointed out, however, that the invention be not limited by the nature of the working examples, and various modifications may be made within the scope of the teachings described in the foregoing and hereinafter without departing from the spirit or scope of the invention.

Ingot steels of chemical compositions shown in Table 1 were formed into slabs to be subsequently hot rolled at 1200° C. The rolling temperatures for hot rolling are shown in Table 2. After hot rolling, cooling was executed in two stages with intermediate air cooling interposed therebetween, and workpieces were taken up at winding temperatures shown in Table 2, having thereby obtained hot rolled steel sheets each 3.2 mm thick. Table 2 shows the cooling velocity for the period from the rolling temperature up to the primary cooling stop temperature (the primary cooling velocity), the primary cooling stop temperature, the intermediate cooling time, and the cooling velocity for the period from the intermediate cooling completion temperature up to the winding temperature (the secondary cooling velocity) that were adopted in this case.

TABLE 1

| Steel | Chemical compositions (mass %) | | | | | | | |
|---|---|---|---|---|---|---|---|---|
| type | C | Si | Mn | P | S | Al | Cr | Others |
| 1 | 0.037 | 0.06 | 1.0 | 0.051 | 0.005 | 0.04 | 0.33 | — |
| 2 | 0.083 | 0.04 | 1.2 | 0.032 | 0.002 | 0.03 | 0.65 | — |
| 3 | 0.118 | 0.06 | 1.4 | 0.043 | 0.002 | 0.04 | 0.85 | — |
| 4 | 0.065 | 0.04 | 0.7 | 0.036 | 0.003 | 0.05 | 0.74 | — |
| 5 | 0.072 | 0.05 | 1.6 | 0.074 | 0.001 | 0.03 | 0.92 | — |
| 6 | 0.068 | 0.03 | 0.9 | 0.038 | 0.003 | 0.03 | 0.62 | — |
| 7 | 0.083 | 0.01 | 1.0 | 0.075 | 0.005 | 0.06 | 0.77 | — |
| 8 | 0.065 | 0.02 | 1.4 | 0.038 | 0.005 | 0.03 | 0.47 | — |
| 9 | 0.094 | 0.03 | 1.6 | 0.069 | 0.005 | 0.06 | 0.69 | — |
| 10 | 0.039 | 0.01 | 1.6 | 0.043 | 0.002 | 0.05 | 0.54 | Ni: 0.21, Cu: 0.3 |
| 11 | 0.061 | 0.07 | 0.8 | 0.057 | 0.004 | 0.04 | 0.45 | Ni: 0.38, Cu: 0.64 |
| 12 | 0.051 | 0.03 | 1.4 | 0.067 | 0.003 | 0.07 | 0.87 | Co: 0.05 |
| 13 | 0.069 | 0.04 | 0.9 | 0.052 | 0.004 | 0.04 | 0.57 | Co: 0.23 |
| 14 | 0.076 | 0.07 | 0.6 | 0.078 | 0.002 | 0.07 | 0.38 | Ca: 0.0023 |
| 15 | 0.053 | 0.03 | 1.3 | 0.055 | 0.005 | 0.05 | 0.88 | Nb: 0.04 |
| 16 | 0.067 | 0.03 | 0.7 | 0.059 | 0.003 | 0.03 | 0.68 | Ti: 0.07 |
| 17 | 0.082 | 0.07 | 0.9 | 0.068 | 0.002 | 0.03 | 0.46 | V: 0.16 |
| 18 | 0.074 | 0.06 | 0.7 | 0.036 | 0.001 | 0.06 | 0.89 | Mo: 0.31 |
| 19 | 0.097 | 0.02 | 1.1 | 0.036 | 0.004 | 0.05 | 0.36 | B: 0.0014 |
| 20 | 0.078 | 0.24 | 0.9 | 0.047 | 0.003 | 0.06 | 0.71 | — |
| 21 | 0.076 | 0.09 | 0.7 | 0.024 | 0.001 | 0.06 | 0.64 | — |
| 22 | 0.065 | 0.07 | 1.2 | 0.091 | 0.002 | 0.05 | 0.52 | — |
| 23 | 0.074 | 0.08 | 1.6 | 0.044 | 0.003 | 0.05 | 0.17 | — |
| 24 | 0.093 | 0.04 | 1.4 | 0.049 | 0.004 | 0.06 | 1.13 | — |
| 25 | 0.072 | 0.07 | 1.2 | 0.082 | 0.003 | 0.03 | 1.03 | — |

TABLE 2

| No. | Steel type | Hot rolling conditions: Rolling temperature (° C.) | Primary cooling velocity (° C./sec) | Primary cooling stop temperature (° C.) | Air cooling time (sec) | Secondary cooling velocity (° C./sec) | Winding temperature (° C.) |
|---|---|---|---|---|---|---|---|
| 1 | 1 | 850 | 35 | 690 | 8 | 50 | 60 |
| 2 | 2 | 890 | 60 | 690 | 8 | 30 | 50 |
| 3 | 3 | 850 | 55 | 670 | 11 | 45 | 100 |
| 4 | 4 | 850 | 50 | 660 | 12 | 35 | 70 |
| 5 | 5 | 880 | 40 | 670 | 7 | 30 | 90 |
| 6 | 6 | 890 | 50 | 680 | 6 | 35 | 110 |
| 7 | 7 | 880 | 45 | 660 | 13 | 25 | 140 |
| 8 | 8 | 860 | 45 | 660 | 6 | 40 | 130 |
| 9 | 9 | 890 | 55 | 680 | 10 | 45 | 80 |
| 10 | 10 | 870 | 50 | 690 | 12 | 45 | 100 |
| 11 | 11 | 840 | 40 | 690 | 10 | 20 | 80 |
| 12 | 12 | 890 | 30 | 680 | 7 | 45 | 110 |
| 13 | 13 | 860 | 50 | 660 | 8 | 50 | 110 |
| 14 | 14 | 850 | 30 | 690 | 13 | 35 | 120 |
| 15 | 15 | 890 | 50 | 650 | 10 | 40 | 140 |
| 16 | 16 | 890 | 35 | 680 | 7 | 25 | 130 |
| 17 | 17 | 850 | 45 | 650 | 6 | 35 | 120 |
| 18 | 18 | 870 | 30 | 660 | 11 | 25 | 90 |
| 19 | 19 | 840 | 60 | 660 | 12 | 25 | 70 |
| 20 | 20 | 870 | 60 | 650 | 7 | 40 | 80 |
| 21 | 21 | 860 | 60 | 660 | 10 | 30 | 70 |
| 22 | 22 | 870 | 30 | 660 | 11 | 45 | 70 |
| 23 | 23 | 880 | 55 | 680 | 13 | 25 | 130 |
| 24 | 24 | 850 | 45 | 670 | 12 | 25 | 70 |
| 25 | 25 | 860 | 50 | 660 | 10 | 35 | 120 |

After subjecting the hot rolled steel sheets obtained to pickling, various testpieces were cut out therefrom to be subsequently subjected to a tension tests, fatigue testing, and structure observation, respectively.

As the testpieces for the tension tests, use was made of tensile-test pieces No. 5 in accordance with JIS specification, and with respect to the respective testpieces, yield strength (YS), tensile strength (TS), and total elongation (EI) were measured. Measurement results are shown in Table 3. Based on the results, of the tension tests, respective values of tensile strength (TS)×total elongation (EI) were calculated, and the workability of each of the hot rolled steel sheets was evaluated on the basis of the respective values. The respective testpieces with the value of TS×EI, exceeding 18000, were evaluated as O. K. The values of TS×EI are shown in Table 3.

As the testpieces for the fatigue testing, use was made of tensile-test pieces No. 5 in accordance with JIS specification, and the maximum stress (σw) for unrupture upon excitation of $5\times10^6$ times by alternate repeated bending fatigue testing was measured. Measurement results are shown in Table 3. The fatigue property was evaluated on the basis of a ratio (σw/TS) of the maximum stress (σw) as measured to the tensile strength (TS) as measured by the tension tests. The respective testpieces with the ratio exceeding 0.50 were evaluated as O. K. The values of the ratios are shown in Table 3.

The structure of the steel sheet was observed by use of a scanning electron microscope, and volume fractions of martensite against the whole structure were calculated by the previously described procedure. The volume fractions of the martensite, as calculated, are shown in Table 3. Further, bainite as the third phase, and so on, in small quantities, were observed, however, volume fractions of the third phase were found less than 3%, and the balance was the polygonal ferrite.

As for the surface quality, the hot rolled steel sheets obtained were visually observed, and evaluation was made on the basis of whether or not surface defects (scale marks) exist. Evaluation criteria were as follows, and evaluation results are shown in Table 3.

Evaluation Criteria

TABLE 3

| No. | Tension tests: YS (MPa) | TS (MPa) | EI (%) | Fatigue testing: σw (MPa) | Composition: Martensite (volume %)) | Properties: TS × EI | σw/TS | Scale marks |
|---|---|---|---|---|---|---|---|---|
| 1 | 293 | 542 | 36 | 286 | 8 | 19512 | 0.53 | ○ |
| 2 | 356 | 655 | 30 | 342 | 12 | 19650 | 0.52 | ○ |
| 3 | 452 | 712 | 27 | 380 | 19 | 19224 | 0.53 | ○ |
| 4 | 369 | 631 | 31 | 330 | 13 | 19561 | 0.52 | ○ |
| 5 | 422 | 705 | 27 | 368 | 14 | 19035 | 0.52 | ○ |
| 6 | 393 | 624 | 31 | 329 | 11 | 19344 | 0.53 | ○ |
| 7 | 394 | 680 | 28 | 357 | 13 | 19040 | 0.53 | ○ |
| 8 | 346 | 587 | 33 | 309 | 12 | 19371 | 0.53 | ○ |

TABLE 3-continued

| | Tension tests | | | Fatigue testing | Composition | Properties | | |
|---|---|---|---|---|---|---|---|---|
| No. | YS (MPa) | TS (MPa) | EI (%) | σw (MPa) | Martensite (volume %)) | TS × EI | σw/TS | Scale marks |
| 9 | 423 | 714 | 27 | 373 | 17 | 19278 | 0.52 | ○ |
| 10 | 350 | 606 | 32 | 322 | 11 | 19392 | 0.53 | ○ |
| 11 | 340 | 591 | 33 | 316 | 10 | 19503 | 0.53 | ○ |
| 12 | 431 | 699 | 28 | 375 | 13 | 19572 | 0.54 | ○ |
| 13 | 368 | 623 | 32 | 329 | 11 | 19936 | 0.53 | ○ |
| 14 | 338 | 578 | 34 | 306 | 11 | 19652 | 0.53 | ○ |
| 15 | 417 | 677 | 28 | 364 | 14 | 18956 | 0.54 | ○ |
| 16 | 428 | 651 | 29 | 347 | 14 | 18879 | 0.53 | ○ |
| 17 | 392 | 634 | 29 | 337 | 13 | 18386 | 0.53 | ○ |
| 18 | 393 | 683 | 27 | 358 | 15 | 18441 | 0.52 | ○ |
| 19 | 325 | 584 | 33 | 314 | 14 | 19272 | 0.54 | ○ |
| 20 | 407 | 666 | 28 | 355 | 12 | 18648 | 0.53 | X |
| 21 | 413 | 657 | 26 | 331 | 13 | 17082 | 0.50 | ○ |
| 22 | 387 | 647 | 28 | 302 | 12 | 18116 | 0.47 | ○ |
| 23 | 301 | 554 | 31 | 257 | 11 | 17174 | 0.46 | ○ |
| 24 | 498 | 742 | 23 | 373 | 22 | 17066 | 0.50 | ○ |
| 25 | 456 | 692 | 25 | 329 | 19 | 17300 | 0.48 | ○ |

Symbol ○: no scale mark observed
Symbol Δ: scale marks locally observed
Symbol X: scale marks observed substantially throughout the surface On the basis of Table 3, the following view can be taken. Testpieces No. 1 through 19 are examples meeting requirements specified by the invention, each representing a high-strength hot-rolled steel sheet, superior in workability, fatigue property, and also excellent in surface quality. On the other hand, testpieces No. 20 through 25 are examples failing to meet and of the requirements specified by the invention, each representing a high-strength hot-rolled steel sheet, inferior in any of properties such as workability, fatigue property, and surface quality.

What is claimed is:

1. A high-strength hot-rolled steel sheet, superior in workability, fatigue property, and surface quality, said high-strength hot-rolled steel sheet consisting essentially of:

C in a range of 0.03 to 0.15 mass %;

Mn in a range of 0.5 to 2 mass %;

Al in a range of 0.01 to 0.1 mass %;

P in a range of 0.038 to 0.072 mass %; and

Cr in a range of 0.4 to 0.91 mass %, respectively, while controlling S to not more than 0.02 mass % (0% included), and Si to not more than 0.1 mass % (0% included), wherein a metallic structure has polygonal ferrite as the main phase, and contains martensite as a second phase; and wherein the high-strength hot-rolled steel sheet does not contain Nb and Ti.

2. The high-strength hot-rolled steel sheet according to claim 1, wherein the polygonal ferrite is not less than 75% in terms of volume fraction.

3. The high-strength hot-rolled steel sheet according to claim 1, wherein the martensite is in a range of 3 to 20% in terms of volume fraction.

4. The high-strength hot-rolled steel sheet according to claim 1, further containing at least either of Ni in a range of 0.1 to 1 mass %, and Cu in a range of 0.1 to 1 mass %, as other elements.

5. The high-strength hot-rolled steel sheet according to claim 1, further containing Co in a range of 0.01 to 1 mass % as another element.

6. The high-strength hot-rolled steel sheet according to claim 1, further containing Ca at not more than 0.005 mass % (0% not included) as another element.

7. The high-strength hot-rolled steel sheet according to claim 1, further containing at least one element selected from the group consisting of V in a range of 0.01 to 0.5 mass %, Mo in a range of 0.05 to 1 mass %, and B in a range of 0.0003 to 0.01 mass %, as other elements.

8. A method of making a high-strength hot-rolled steel sheet, the method comprising rolling into a sheet a steel containing C, Mn, Al, P and Cr; and producing the steel sheet of claim 1.

* * * * *